US005860835A

United States Patent [19]

Ohsumi

[11] Patent Number: 5,860,835

[45] Date of Patent: Jan. 19, 1999

[54] CONNECTOR

[75] Inventor: Hideki Ohsumi, Shizuoka, Japan

[73] Assignee: Yazaki Corporation, Tokyo, Japan

[21] Appl. No.: 70,242

[22] Filed: May 1, 1998

[30] Foreign Application Priority Data

May 20, 1997 [JP] Japan ..... 9-129913

[51] Int. Cl.[6] ..... H01R 13/40

[52] U.S. Cl. ..... 439/595; 439/752

[58] Field of Search ..... 439/488, 595, 439/752, 752.5

[56] References Cited

U.S. PATENT DOCUMENTS 5,743,762 4/1998 Takahashi ..... 439/595

*Primary Examiner*—Neil Abrams
*Assistant Examiner*—Antoine Ngandjui
*Attorney, Agent, or Firm*—Morgan, Lewis & Bockius LLP

[57] ABSTRACT

A connector including a plurality of terminals, a housing having a plurality of cavities, and a front holder to be inserted into the cavities. Each of the terminals has a resilient portion which forces the terminal up in a direction perpendicular to a direction of insertion of the terminal when the terminal is inserted into a proper position in the cavity. A limitation portion is provided in each of the cavities, and the limitation portion forces the terminal down in a direction perpendicular to the direction of insertion of the terminal until the terminal is inserted into the proper position in the cavity. The front holder has a plurality of push arms arranged like teeth of a comb, and when each of the terminals is inserted into the proper position in the associated cavity, each of the push arms is inserted into a space formed by the terminal, forced up by the resilient portion, and a cavity wall. When any of the terminals is not inserted into the proper position in the cavity, the associated push arm abuts against the terminal, thereby pushing this terminal out of the cavity.

7 Claims, 10 Drawing Sheets

CONNECTOR

BACKGROUND OF THE INVENTION

1. Field of the Invention

This invention relates to a connector in which the half insertion of terminals is detected by a front holder, and more particularly to a connector in which the half insertion of terminals can be positively detected, and any half-inserted terminal among the plurality of terminals can be easily specified.

2. Description of the Related Art

FIG. 9 is a cross-sectional view showing a conventional connector in which the half insertion of terminals is detected by a front holder.

In this Figure, the connector 100 comprises terminals 101, a housing 110, and the front holder 120.

The housing 110 has cavities 111 for respectively receiving the terminals 101, and a lance 112 for retaining the inserted terminal 101 is provided in the cavity 111 in a projected manner.

A front-holder receiving portion 113 for receiving the front holder 120 is formed in a bottom wall of the cavity 111.

Although not shown in the drawings, the cavities 111, as well as the lances 112 and the front-holder receiving portions 113, are arranged in a juxtaposed manner within the housing 110, and correspond to the plurality of terminals 101, respectively.

The front holder 120 has a plate-like or a comb-like shape corresponding to the front-holder receiving portions 113 formed respectively in the cavities 111.

In this conventional connector, when each terminal 101 is inserted into a proper position in the cavity 111 as shown in FIG. 10(*a*), the front holder 120 can be inserted into the front-holder receiving portions 113 until it reaches the inner ends of the front holder-receiving portions 113, and the lances 112 are forced up toward the terminals 101 by the front holder 120.

As a result, each lance 112 retains the associated terminal 101, thus holding the terminal 101 in the cavity 111.

When the terminal 101 is not inserted into the proper position in the cavity 111 (that is, the terminal 101 is in a half-inserted condition) as shown in FIG. 10(*b*), the distal end of the lance 112, pressed by the terminal 101, interferes with the front-holder receiving portion 113, and the front holder 120 can not be inserted as far as the inner end of the front-holder receiving portion 113.

Therefore, the operator can detect the half insertion of the terminal 101.

In the above conventional connector, however, although the half insertion of the terminal 101 can be detected, it is impossible to specify which terminal 101 is in a half-inserted condition since the plurality of terminals 101 are received respectively in the plurality of cavities 111, and thus there has been encountered a problem that much time and labor are required for specifying the half-inserted terminal 101.

More specifically, the half-inserted terminal 101 in the cavity 111 can not be specified from the appearance, and therefore the half-inserted terminal 101 must be found, for example, by pushing the plurality of terminals 101 one by one into the respective cavities 111.

SUMMARY OF THE INVENTION

With the above problem in view, it is an object of this invention to provide a connector in which the half insertion of a terminal can be positively detected, and any half-inserted terminal among a plurality of terminals can be easily specified.

In order to achieve the above object, the invention provides a connector comprising a plurality of terminals, a housing having a plurality of cavities for respectively receiving the terminals, and a front holder to be inserted into the cavities in the housing, wherein each of the terminals has a resilient portion which forces the terminal up in a direction perpendicular to a direction of insertion of the terminal when the terminal is inserted into a proper position in the cavity; wherein a limitation portion is provided in each of the cavities, and the limitation portion forces the terminal down in a direction perpendicular to the direction of insertion of the terminal until the terminal is inserted into the proper position in the cavity; and wherein the front holder has a plurality of push arms arranged like teeth of a comb, and when each of the terminals is inserted into the proper position in the cavity, each of the push arms is inserted into a space formed by the terminal, forced up by the resilient portion, and a wall of the cavity, thereby retaining the terminal in the cavity, and when any of the terminals is not inserted into the proper position in the cavity, the push arm abuts against the terminal forced down by the limitation portion, thereby pushing the terminal out of the cavity.

BRIEF DESCRIPTION OF THE DRAWINGS

FIG. 3(*b*) is a plan view thereof;

FIG. 3(*c*) is a front-elevational view thereof;

FIG. 4(*b*) is a cross-sectional view showing the push arm and the stopper arm;

FIG. 10(*b*) is a view explanatory of the operation of the conventional connector when any of the terminals is not inserted into the proper position in the cavity.

DETAILED DESCRIPTION OF THE PREFERRED EMBODIMENTS

Preferred embodiments of a connector of the present invention will be described with reference to the drawings.

First, a first embodiment of the invention will now be described.

Figure 1:
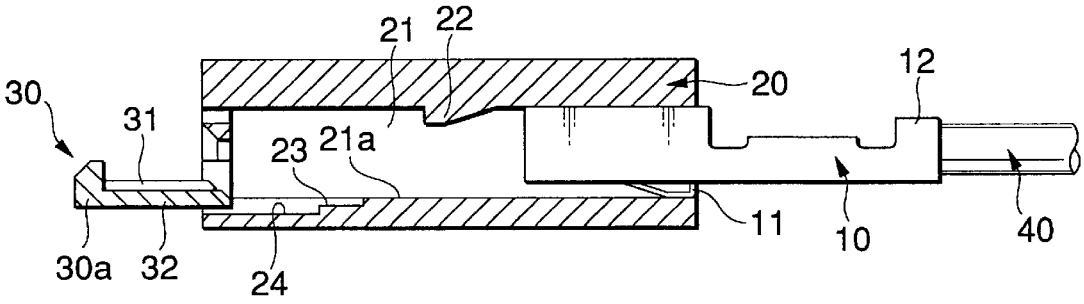
FIG. 1 is a cross-sectional view of a preferred embodiment of a connector of the present invention.

FIG. 1 is a cross-sectional view of a connector of this embodiment.

Figure 2:
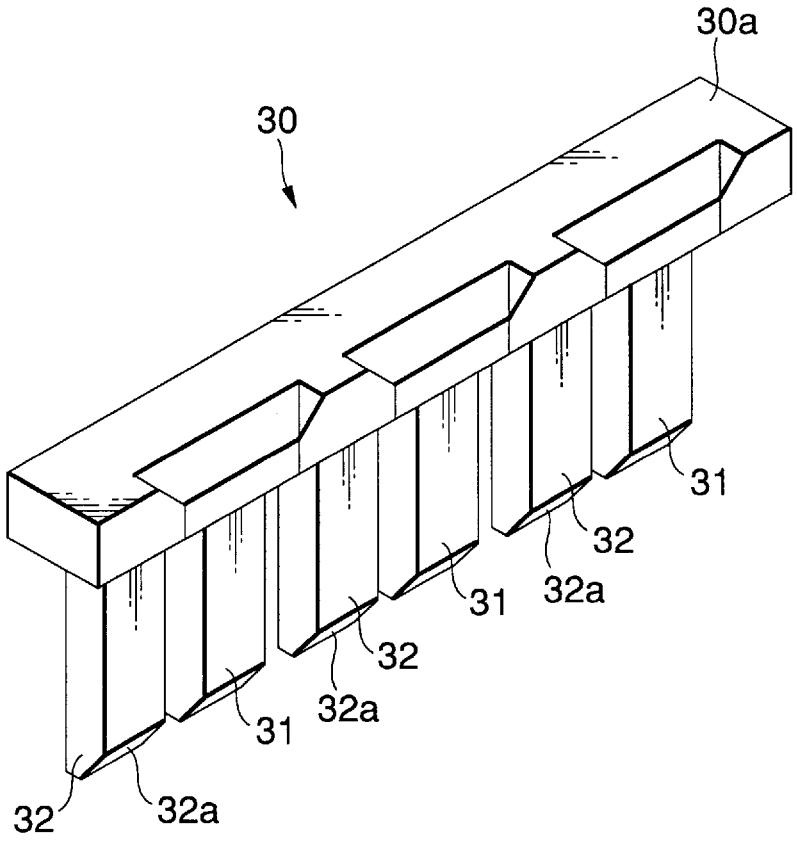
FIG. 2 is a perspective view of a front holder of the connector.
Figure 3A:
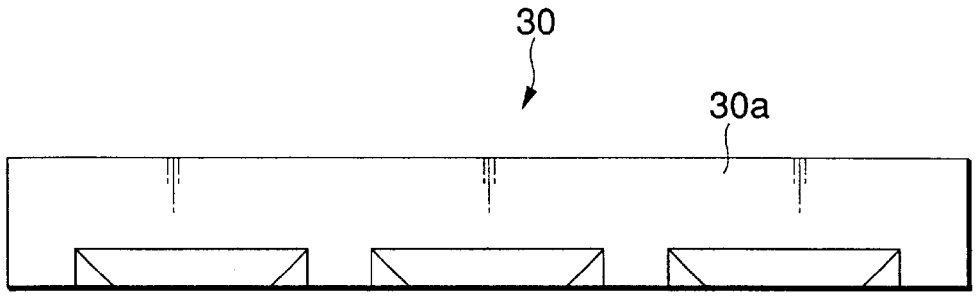
FIG. 3(*a*) is a rear view of the front holder.
Figure 3B:
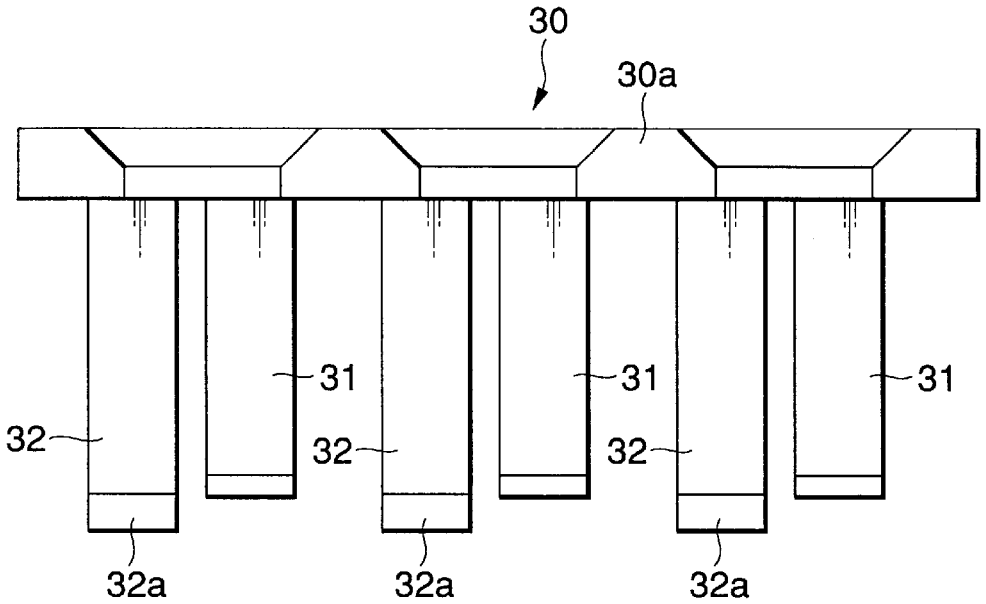
Figure 3C:
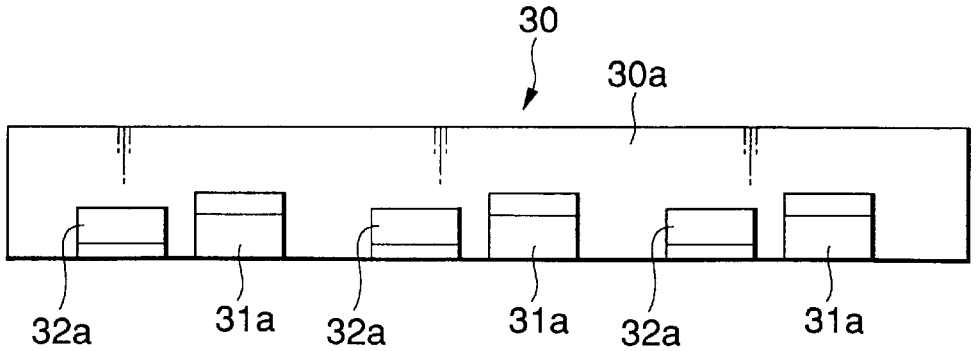
Figure 4A:
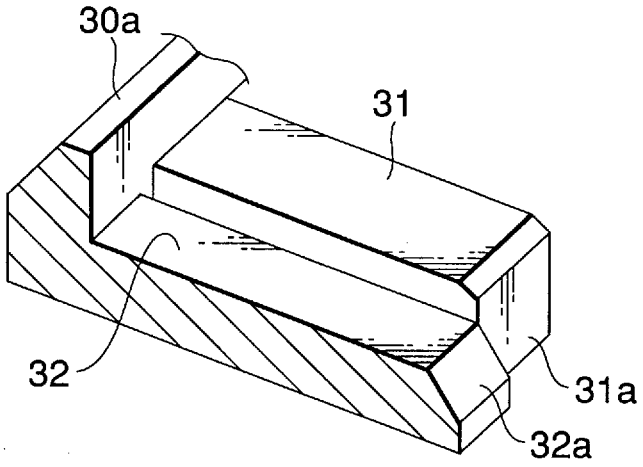
FIG. 4(*a*) is a perspective view showing a push arm and a stopper arm of the front holder.
Figure 4B:
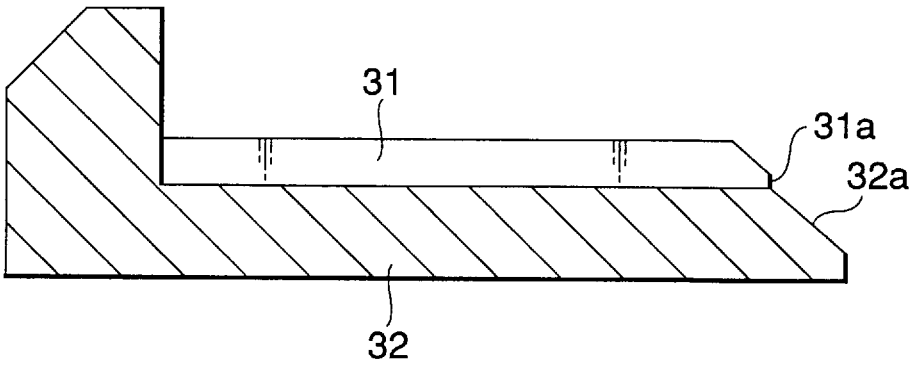
Figure 5A:
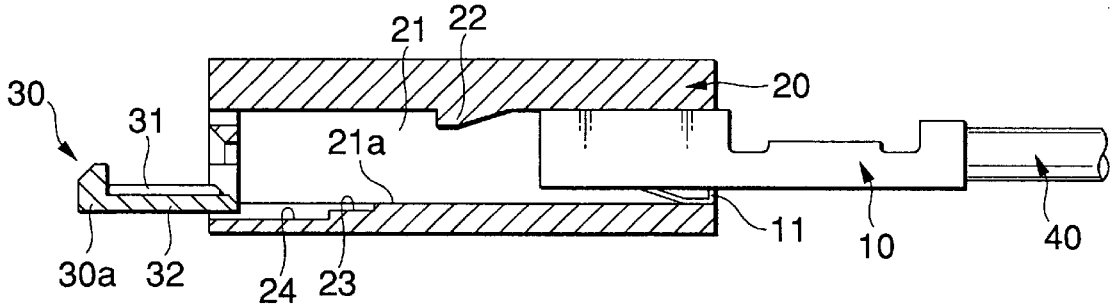
FIGS. 5(*a*) to 5(*d*) are views explanatory of the operation of the front holder when each of the terminals is inserted into a proper position in a cavity.
Figure 5B:
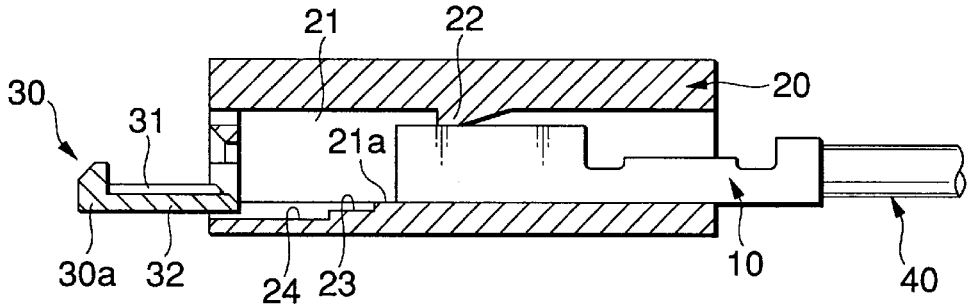
Figure 5C:
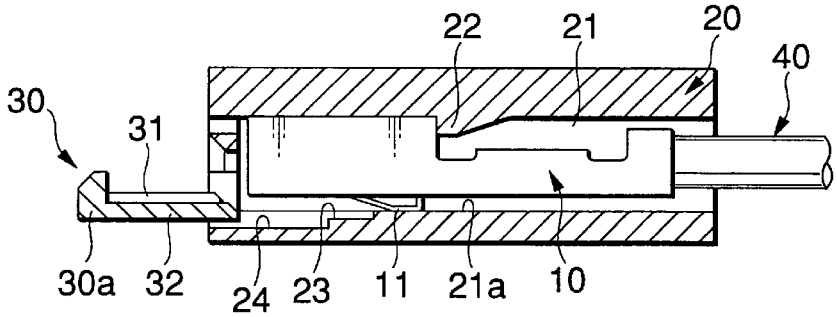
Figure 5D:
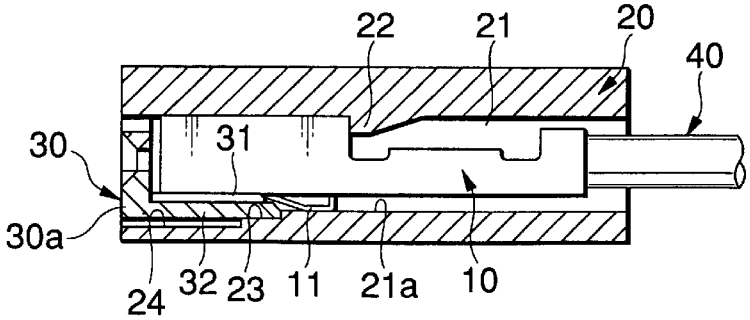
Figure 6A:
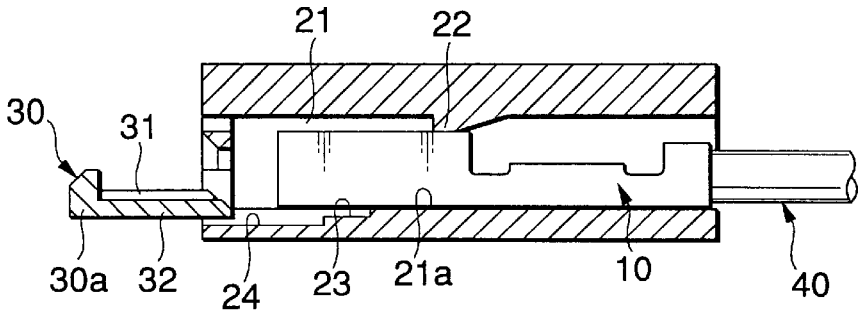
FIGS. 6(*a*) to 6(*d*) are views explanatory of the operation of the front holder when any of the terminals is not inserted into the proper position in the cavity.
Figure 6B:
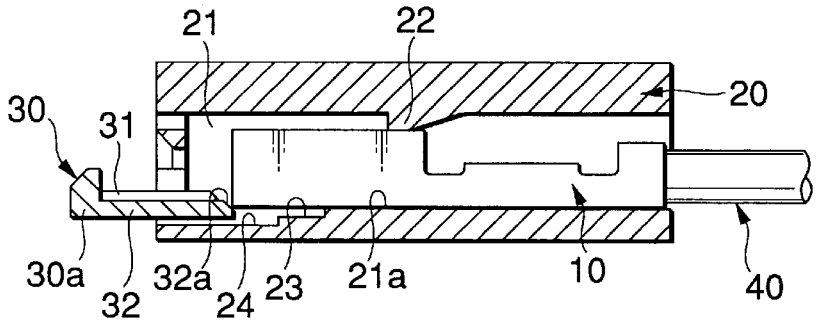
Figure 6C:
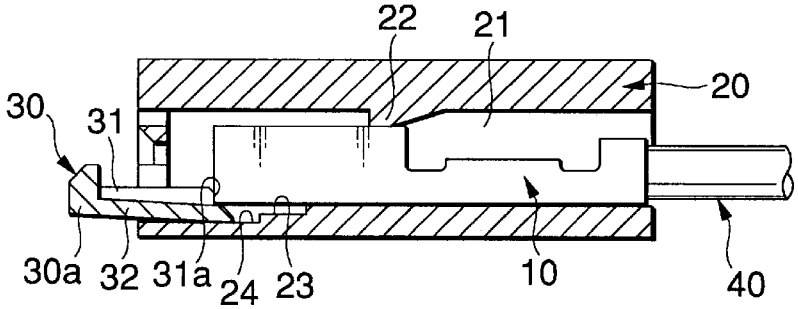
Figure 6D:
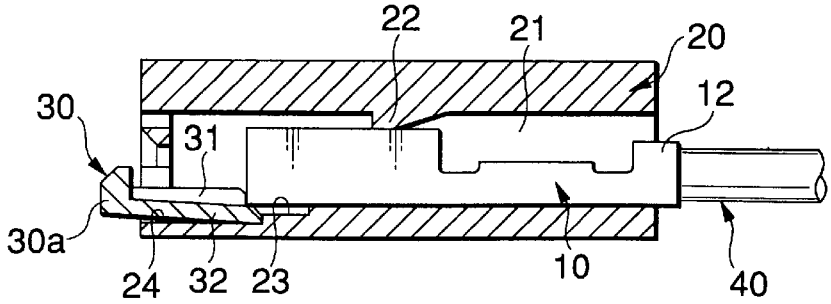
Figure 7A:
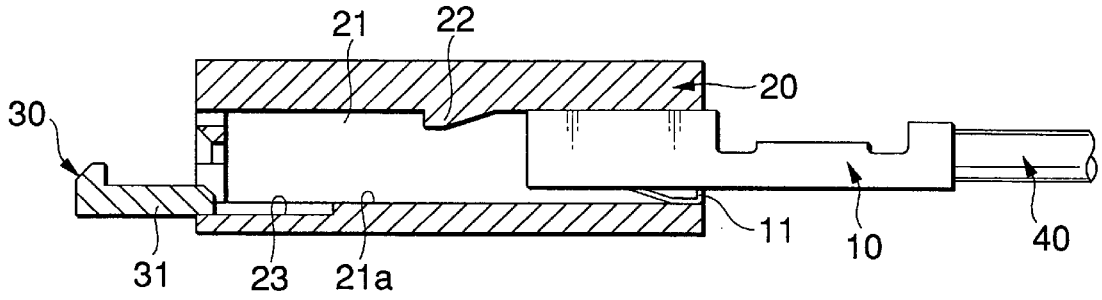
FIGS. 7(*a*) to 7(*d*) are views explanatory of the operation of a front holder for a second embodiment of the connector of the invention when each terminal is inserted into a proper position in a cavity.
Figure 7B:
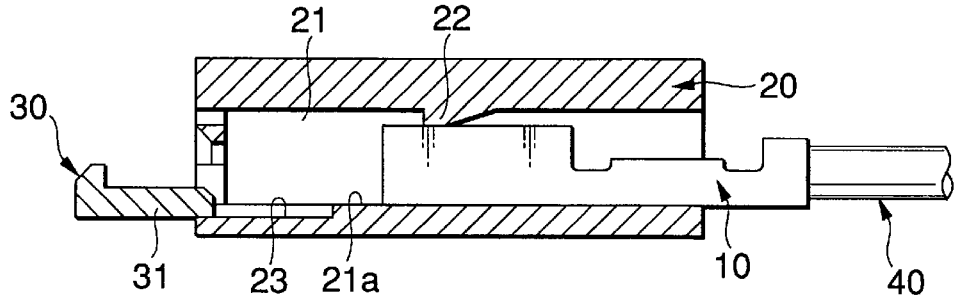
Figure 7C:
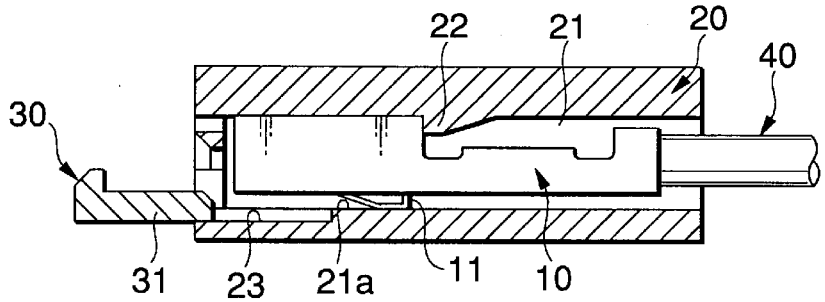
Figure 7D:
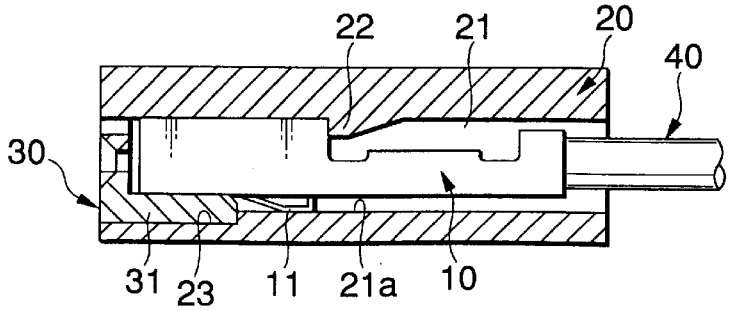

FIG. 2 is a perspective view of a front holder of the connector. FIG. 3(*a*) is a rear view of the front holder, FIG. 3(*b*) is a plan view thereof, and FIG. 3(*c*) is a front-elevational view thereof. FIG. 4(*a*) is a perspective view showing a push arm and a stopper arm of the front holder, and FIG. 4(*b*) is a cross-sectional view showing the push arm and the stopper arm.

In FIG. 1, the connector of this embodiment comprises a plurality of terminals 10, a housing 20 having a plurality of cavities 21 for respectively receiving the terminals 10, and a front holder 30 to be inserted into the cavities 21.

Each of the terminals 10 has a resilient portion 11 which forces the terminal up in a direction perpendicular to a direction of insertion of the terminal when the terminal is inserted into a proper position in the associated cavity 21. A clamping portion 12 is formed at a rear end of each of the terminals 10, and a wire 40 is clamped by the clamping portion 12.

A claw-like lance (limitation portion) 22 is provided in a projected manner in each cavity 21 in the housing 20, and the lance 22 retains the terminal 10 in the cavity 21 when the terminal 10 is inserted into the proper position in the cavity 21.

The lance 22 forces the terminal 10 down in a direction perpendicular to the direction of insertion of the terminal 10 until the terminal 10 is inserted into the proper position in the cavity 21.

A first step portion 23 and a second step portion 24 are formed at a cavity wall 21*a* of each of the cavities 21, and the first step portion 23 is lower than the cavity wall 21*a*, and the second step portion 24 is lower than the first step portion 23.

When the terminal 10 is inserted into the proper position in the cavity 21, the first step portion 23 cooperates with the terminal 10 to form a receiving space therebetween for receiving the associated push arm 31 and stopper arm 32 of the front holder 30.

When the terminal 10 is not inserted into the proper position in the cavity 21, the second step portion 24 cooperates with the terminal 10 to form a sliding space therebetween for the associated stopper arm 32 which abuts against and is bent by the front end of the terminal 10.

As shown in FIG. 2, the front holder 30 includes the push arms 31 and the stopper arms 32 alternately formed on and extending from a plate-like base portion 30*a* like teeth of a comb.

In this embodiment, three pairs of push arms 31 and stopper arms 32, corresponding to the three terminals 10, are formed.

In FIGS. 1 and 3(*a*) to 3(*b*), when the terminal 10 is inserted into the proper position in the cavity 21, the associated push arm 31 is inserted into the space formed between the terminal 10 (forced up by the resilient portion 11) and the first step portion 23 (that is, the cavity wall 21*a*), and holds the terminal 10 in the cavity 21. When the terminal 10 is not inserted into the proper position in the cavity 21, the associated push arm 31 abuts against the terminal 10 forced down by the lance 22, and pushes or forces the terminal 10 out of the cavity 21.

As shown in FIGS. 3(*c*), 4(*a*) and 4(*b*), the distal end of the push arm 31 is formed into an abutment surface 31*a*, and the push arm 31 is increased in thickness to have increased rigidity. With this construction, when the terminal 10 is not inserted into the proper position in the cavity 21, the push arm 31 abuts against the front end of the terminal 10, and can smoothly push the terminal 10 out of the cavity 21.

When the terminal 10 is inserted into the proper position in the cavity 21, the associated stopper arm 32 is inserted into the space formed between the terminal 10 (forced up by the resilient portion 11) and the first step portion 23. When the terminal 10 is not inserted into the proper position in the cavity 21, the associated stopper arm 32 is guided to the front end of the terminal 10 forced down by the lance 22, and abuts against an inner end wall of the second step portion 24, thereby preventing the front holder 30 from further advancing.

A slanting guide surface 32*a* is formed at the distal end of the stopper arm 32, and the slanting guide surface 32*a* abuts against the front end of the half-inserted terminal 10, so that the stopper arm 32 is guided toward the second step portion 24, and finally the distal end of the stopper arm 32 abuts against the inner end wall of the second step portion 24.

As shown in FIGS. 3(*c*), 4(*a*) and 4(*b*), the stopper arm 32 is so reduced in thickness that it can be easily bent or flexed.

With this construction, when the distal end of the stopper arm 32 abuts against the front end of the half-inserted terminal 10, the stopper arm 32 is smoothly guided toward the first and second step portions 23 and 24.

The stopper arms 32 are formed at the lower side of the front holder 30 so as to be disposed close to the respective cavity walls 21*a*.

With this construction, each stopper arm 32, when slightly bent, can abut against the inner end wall of the associated second step portion 24.

The operation of the front holder of the above connector will now be described with reference to FIGS. 5(*a*) to 5(*d*) and 6(*a*) to 6(*d*).

FIGS. 5(*a*) to 5(*d*) are views explanatory of the operation of the front holder when each of the terminals is inserted into the proper position in the cavity.

FIGS. 6(*a*) to 6(*d*) are views explanatory of the operation of the front holder when any of the terminals is not inserted into the proper position in the cavity.

As shown in FIG. 5(*a*), when each terminal 10 is inserted into the associated cavity 21 in the housing 20, the terminal 10 is forced up by the resilient portion 11 until the terminal 10 abuts against the lance 22.

Then, when the front end of the terminal 10 abuts against the lance 22 as shown in FIG. 5(*b*), the terminal 10 is forced down toward the cavity wall 21*a*.

Then, when the terminal 10 is further inserted into the proper position in the cavity 21 as shown in FIG. 5(*c*), the lance 22 retains the terminal 10, and also the resilient portion 11 forces the terminal 10 up. As a result, the space is formed between the terminal 10 and the first step portion 23.

Then, when the front holder 30 is pushed into the cavities 21 as shown in FIG. 5(*d*), the corresponding push arm 31 and stopper arm 32 are inserted into the space formed between the associated terminal 10 (forced up by the resilient portion 11) and the associated first step portion 23.

Then, when the front holder 30 is further inserted into a proper position in the cavity 21, the distal end of the stopper arm 32 abuts against the inner end wall of the first step portion 23, thereby stopping the advance of the front holder.

Thus, the attachment of the front holder 30 to the housing 20 is completed, and the terminal 10 is fixed in the proper position in the cavity 21.

Next, description will be made of the operation of the front holder 30 when any of the terminals 10 is not inserted into the proper position in the cavity 21.

When the terminal 10 is not inserted into the proper position in the cavity 21 as shown in FIG. 6(*a*), the terminal 10 is forced down by the lance 22 to be held against the cavity wall 21*a*.

In this condition, when the front holder 30 is pushed into the cavities 21 as shown in FIG. 6(*b*), the slanting guide surface 32*a* of the corresponding stopper arm 32 is first brought into abutment against the front end of the terminal 10.

Then, as shown in FIG. 6(*c*), the front end of the stopper arm 32 is guided toward the front end of the terminal 10, and is bent toward the second step portion 24. At this time, the abutment surface 31*a* of the push arm 31 abuts against the front end of the terminal 10.

Then, when the front holder 30 is further inserted into the cavities 21 as shown in FIG. 6(*d*), the stopper arm 32 slides over the second step portion 24, and also the push arm 31 pushes the terminal 10 out of the cavity 21.

As a result, the distal end of the stopper arm 32 abuts against the inner end wall of the second step portion 24, thereby preventing the front holder 30 from further advancing, and at the same time the clamping portion 12 of the terminal 10 is exposed to the exterior of the cavity 21.

In the connector of this embodiment, the associated push arm (or arms) 31 of the front holder 30 pushes only the half-inserted terminal (or terminals) 10 out of the cavity (or cavities) 21, and therefore the half-inserted terminal 10 (or terminals) can be easily specified.

Besides, since the stopper arm 32 prevents the advance of the front holder 30, the half insertion of the terminal 10 can be positively detected.

Next, a second embodiment of the connector of the invention will be described with reference to FIGS. 7(*a*) to 7(*d*) and 8(*a*) to 8 (*b*).

FIGS. 7(*a*) to 7(*d*) are views explanatory of the operation of a front holder for the connector of this second embodiment when each terminal is inserted into a proper position in a cavity.

Figure 8A:
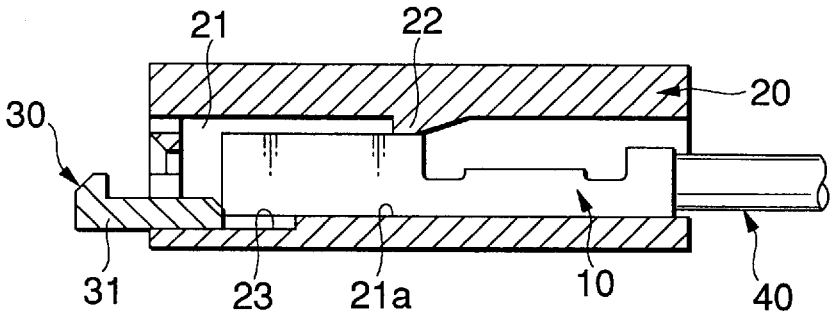
FIGS. 8(*a*) and 8(*b*) are views explanatory of the operation of the front holder for the connector of the second embodiment when any of the terminals is not inserted into the proper position in the cavity.
Figure 8B:
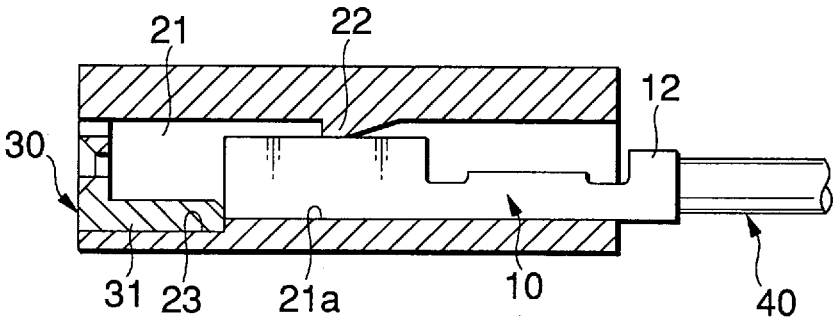
Figure 9:
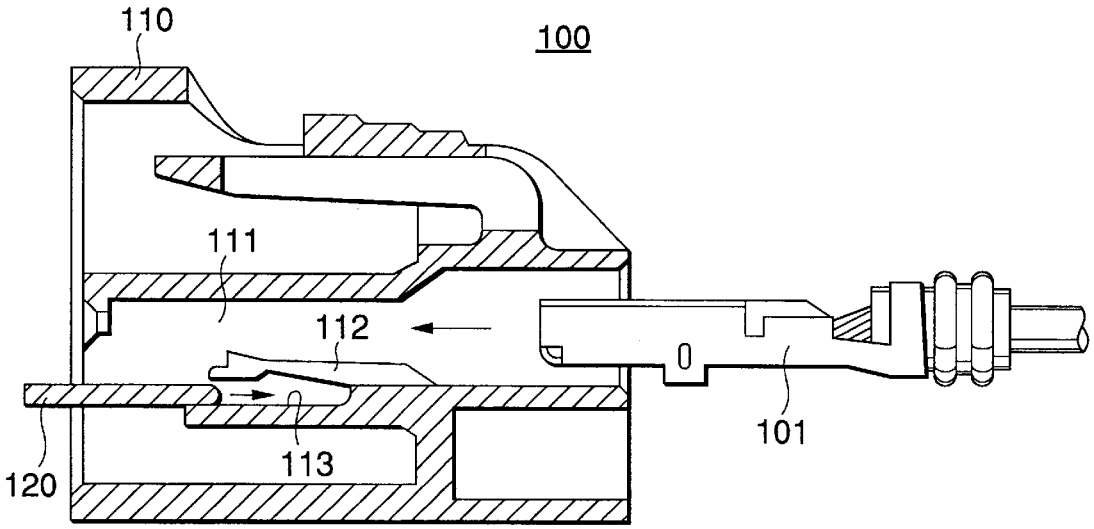
FIG.9 PRIOR ART
FIG. 9 is a cross-sectional view showing a conventional connector with a front holder.
Figure 10A:
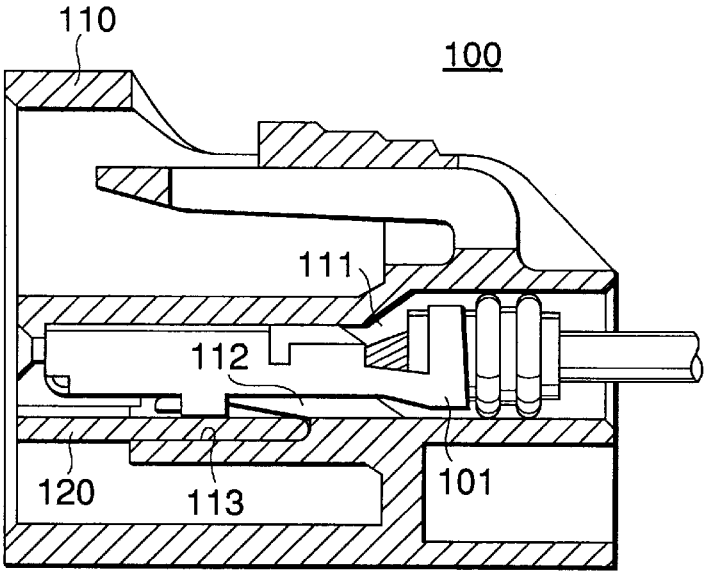
FIG.10(a) PRIOR ART
FIG. 10(*a*) is a view explanatory of the operation of the conventional connector when each terminal is inserted into a proper position in a cavity.
Figure 10B:
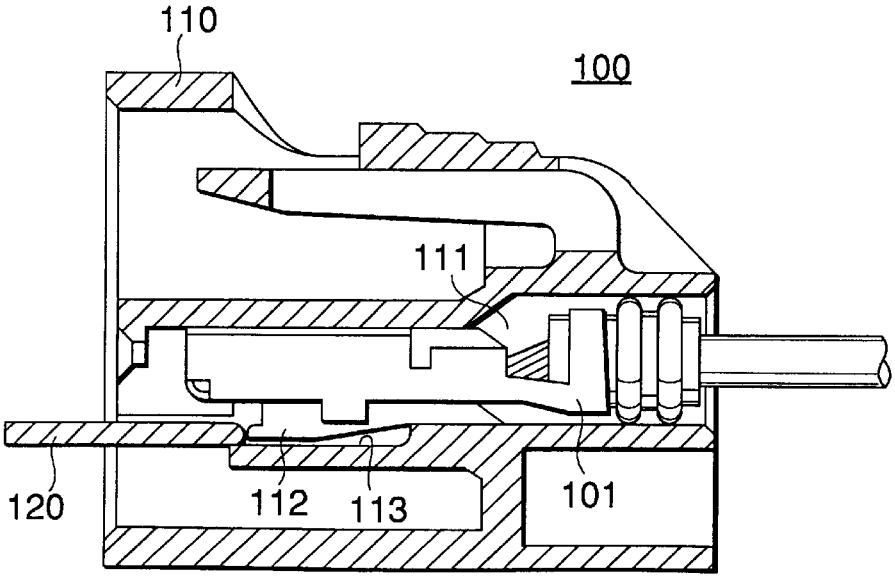
FIG.10(b) PRIOR ART

FIGS. 8(*a*) and 8(*b*) are views explanatory of the operation of the front holder for the connector of the second embodiment when any of the terminals is not inserted into the proper position in the cavity.

In this embodiment, only push arms 31 are formed on a front holder 30 like teeth of a comb, and only a first step portion 23 is formed at each cavity wall 21*a* of a housing 20.

In the connector of this embodiment having the above construction, as shown in FIGS. 7(*a*) to 7(*d*), when each terminal 10 is inserted into the proper position in the associated cavity 21, a space is formed between the terminal 10 (forced up by a resilient portion 11) and the first step portion 23, this space having a width substantially equal to a longitudinal width of the push arm 31.

Then, when the front holder 30 is pushed into the cavities 21, each push arm 31 is inserted into the space between the associated terminal 10 and the associated first step portion 23, so that the terminal 10 is fixed in the proper position in the cavity 21.

As shown in FIG. 8(*a*) and 8(*b*), when any of the terminals 10 is not inserted into the proper position in the cavity 21, the space, formed between this terminal 10 (forced down by a lance 22) and the first step portion 23, is smaller than the longitudinal width of the push arm 31.

In this condition, when the front holder 30 is pushed into the cavities 21, the distal end of the associated push arm 31 abuts against the terminal 10, and this terminal 10 is pushed out of the cavity 21 as the front holder 30 is advanced.

As a result, the clamping portion 12 of the terminal 10 is exposed to the exterior of the cavity 21, so that the half insertion of the terminal 10 can be detected.

In the connector of the second embodiment, as in the first embodiment, the associated push arm (or arms) 31 of the front holder 30 pushes only the half-inserted terminal (or terminals) 10 out of the cavity (or cavities) 21, and therefore the half-inserted terminal (or terminals) 10 can be easily specified.

The connector of the present invention is not limited to the above first and second embodiments.

For example, in the first embodiment, although the stopper arms 32 are formed at the lower side of the base portion 30*a*, the stopper arms 32 may be formed at the upper side of the base portion 30*a* if the positions of formation of the resilient portion 11, the lance 22 and the first and second step portions 23 and 24 are reversed in the upward-downward direction.

In the first embodiment in which the front holder 30 includes the push arms 31 and the stopper arms 32, there may be used a construction in which the first step portion 23 is not formed at each cavity wall 21*a* of the housing 20, and only the second step portion 24, which is lower than the cavity wall 21*a*, is formed at the cavity wall 21*a*.

In the second embodiment in which the front holder 30 has only the push arms 31, there may be used a construction in which any step portion is not formed at each cavity wall 21*a* of the housing 20, and a space for receiving the push arm 31 is formed between the terminal 10 and the cavity wall 21*a*.

As described above, in the connector of the present invention, the half insertion of a terminal can be positively detected, and any half-inserted terminal among the plurality of terminals can be easily specified.

What is claimed is:

1. A connector comprising a plurality of terminals, a housing having a plurality of cavities for respectively receiving said terminals, and a front holder to be inserted into said cavities in said housing, wherein each of said terminals has a resilient portion which forces said terminal up in a direction perpendicular to a direction of insertion of said terminal when said terminal is inserted into a proper position in said cavity;

wherein a limitation portion is provided in each of said cavities, and said limitation portion forces said terminal down in a direction perpendicular to the direction of insertion of said terminal until said terminal is inserted into the proper position in said cavity; and wherein said front holder has a plurality of push arms arranged like teeth of a comb, and when each of said terminals is inserted into the proper position in said cavity, each of said push arms is inserted into a space formed by said terminal, forced up by said resilient portion, and a wall of said cavity, thereby retaining said terminal in said cavity, and when any of said terminals is not inserted into the proper position in said cavity, said push arm abuts against said terminal forced down by said limitation portion, thereby pushing said terminal out of said cavity.

2. The connector according to claim 1, wherein said limitation portion is defined by a lance which retains said terminal in said cavity when said terminal is inserted into the proper position in said cavity.

3. The connector according to claim 1, wherein a first step portion, which is lower than each of cavity walls of said housing, is formed at said each cavity wall, and when said front holder is inserted into a proper position in said cavities, a distal end of said front holder advances toward an inner end wall of said first step portion, thereby stopping an advance of said front holder.

4. The connector according to claim 3, wherein a second step portion, which is lower than each of cavity walls of said housing or said first step portion, is formed at said each cavity wall, and wherein said front holder has a plurality of stopper arms, and said stopper arms and said push arms are arranged alternately, and when each of said terminals is inserted into the proper position in an associated cavity, each of said stopper arms is inserted into a space formed by said terminal, forced up by said resilient portion, and said cavity wall or said first step portion, and when any of said terminals is not inserted into the proper position in said cavity, said stopper arm is guided to a front end of said terminal forced down by said limitation portion, and abuts against an inner end wall of said second step portion, thereby preventing said front holder from further advancing.

5. The connector according to claim 4, wherein each of said stopper arms has a slanting guide surface formed at a distal end thereof, and said slanting guide surface abuts against the front end of said terminal so as to guide the distal end of said stopper arm toward said second step portion.

6. The connector according to claim 4, wherein each of said push arms has a thickness larger than that of each of said stopper arms.

7. The connector according to claim 4, wherein said stopper arms are formed at a lower side of said front holder.

* * * * *